US009297585B2

(12) United States Patent
Zwickel

(10) Patent No.: US 9,297,585 B2
(45) Date of Patent: Mar. 29, 2016

(54) HOOD-TYPE ANNEALING FURNACE AND METHOD FOR OPERATING THE SAME

(71) Applicant: BILSTEIN GMBH & CO. KG, Hagen (DE)

(72) Inventor: Gerald Zwickel, Biedenkopf (DE)

(73) Assignee: Bilstein GmbH & Co. KG, Hagen (DE)

( * ) Notice: Subject to any disclaimer, the term of this patent is extended or adjusted under 35 U.S.C. 154(b) by 190 days.

(21) Appl. No.: 14/093,847

(22) Filed: Dec. 2, 2013

(65) Prior Publication Data

US 2014/0151941 A1 Jun. 5, 2014

(30) Foreign Application Priority Data

Nov. 30, 2012 (DE) ..... 10 2012 023 430

(51) Int. Cl.

| | |
|---|---|
| ***F27D 7/06*** | (2006.01) |
| ***F27B 11/00*** | (2006.01) |
| ***F27D 99/00*** | (2010.01) |
| ***C21D 9/677*** | (2006.01) |
| ***F27D 7/02*** | (2006.01) |
| ***F27D 7/04*** | (2006.01) |

(52) U.S. Cl.

CPC *F27D 7/06* (2013.01); *C21D 9/677* (2013.01); *F27B 11/00* (2013.01); *F27D 7/02* (2013.01); *F27D 7/04* (2013.01); *F27D 99/0006* (2013.01); *F27D 99/0033* (2013.01)

(58) Field of Classification Search

CPC ..... C21D 9/677; F27D 99/006

USPC ..... 266/252

See application file for complete search history.

(56) References Cited

U.S. PATENT DOCUMENTS

| | | | | |
|---|---|---|---|---|
| 8,790,115 | B2 * | 7/2014 | Ebner et al. | 432/207 |
| 2012/0018931 | A1 * | 1/2012 | Ebner et al. | 266/252 |
| 2014/0151941 | A1 * | 6/2014 | Zwickel | 266/44 |

FOREIGN PATENT DOCUMENTS

| | | | |
|---|---|---|---|
| DE | 479851 | C | 7/1929 |
| DE | 1186888 | B | 2/1965 |

* cited by examiner

*Primary Examiner* — Scott Kastler

(74) *Attorney, Agent, or Firm* — Laurence A. Greenberg; Werner H. Stemer; Ralph E. Locher

(57) ABSTRACT

A hood-type annealing furnace for the thermal treatment of cold-rolled steel strip includes a base, a protective hood which can be placed on the latter and under which a protective gas heated by a gas burner is circulated by a blower, to heat the steel strip, rolled up particularly into a coil, under the protective hood to a temperature of at least 500° C. in a protective gas atmosphere. An electric heater fed by the public power network has a heating capacity correspondingly substantially to the heating capacity of the gas burner. The protective gas can be independently heated with the electric heater, alternatively to the gas burner, with the gas burner switched off, to a temperature above the recrystallization annealing temperature. A method for operating a hood-type annealing furnace is also provided.

11 Claims, 3 Drawing Sheets

HOOD-TYPE ANNEALING FURNACE AND METHOD FOR OPERATING THE SAME

CROSS-REFERENCE TO RELATED APPLICATION

This application claims the priority, under 35 U.S.C. §119, of German Patent Application DE 10 2012 023 430.9, filed Nov. 30, 2012; the prior application is herewith incorporated by reference in its entirety.

BACKGROUND OF THE INVENTION

Field of the Invention

The invention relates to a hood-type annealing furnace for the thermal treatment of cold-rolled steel strip, including a base and a protective hood which can be placed on the base and under which a protective gas heated by a gas burner is circulated by a blower, in order to heat the steel strip, which is rolled up, particularly into a coil, under the protective hood to a temperature of at least 500° C. in a protective gas atmosphere. The invention also relates to a method for operating the hood-type annealing furnace.

In the production of cold-rolled steel strip, which among specialists is also designated as "cold strip," a hot strip previously generated by rolling above the recrystallization temperature of steel is rolled down to a thickness of less than 3.0 mm at temperatures below the recrystallization temperature by using one or more further cold-rolling operations, with the result that a thin sheet in a thickness range of 3 mm to 0.5 mm or even less can be produced. Since the metal structure is stretched in the deformation direction during the cold-rolling operation, the strength of the material increases at the same time, whereas its deformability simultaneously decreases because of the strain hardening which occurs. Due to the strain hardening, the cold strip is often too brittle for direct further processing and is therefore often annealed with a recrystallizing effect after the cold-rolling process, in order to thereby restore the formability of the material. Recrystallization annealing is a heat treatment of the cold strip which involves heating the material to a defined temperature above the recrystallization temperature of about 750 degrees Celsius, holding the temperature level for a stipulated period of time of several hours and subsequently cooling the material in a defined way according to a stipulated temperature profile.

The process which the applicant employs for that purpose is so-called hood-type or batch annealing, in which the cold strip is rolled up into a coil and a plurality of those coils are annealed one above the other, under a closed heating hood heated by gas burners, at temperatures of between 500 degrees and 800 degrees Celsius in a protective gas atmosphere of $H_2$ or $NH_x$, so as not to destroy the bright and smooth cold strip surface which is complicated to produce.

A previously-described hood-type annealing furnace which is operated solely by gas during the heating phase is known, for example, from German Patent Application DE 1 186 888 A1.

Furthermore, an annealing furnace is known from German Patent DE 479 851, in which, to heat the protective gas circulated in the furnace, a heater with a high-power gas burner is used, which is followed in terms of flow by an electrical heater for the fine regulation of the temperature of the preheated protective gas. That publication does not suggest heating the protective gas circulated through the furnace either solely by using the gas heater or, alternatively, solely by using the electric heater.

SUMMARY OF THE INVENTION

It is accordingly an object of the invention to provide a hood-type annealing furnace and a method for operating such a hood-type annealing furnace, which overcome the hereinafore-mentioned disadvantages of the heretofore-known furnaces and methods of this general type and through the use of which power fluctuations in a public power network can be evened out.

With the foregoing and other objects in view there is provided, in accordance with the invention, a hood-type annealing furnace for the thermal treatment of cold-rolled steel strip, comprising a base with a protective hood which can be placed on the latter and under which a protective gas, preferably hydrogen or another inert gas, is heated by a gas burner and is circulated by a blower. The steel strip is preferably a steel strip which is rolled up into a coil and has been strain-hardened as a result of a preceding cold-rolling operation. The steel strip is heated in the protective gas atmosphere by the heated protective gas for several hours to a temperature which preferably lies above the recrystallization annealing temperature for the steel material to be annealed and amounts to at least 500° C.

The hood-type annealing furnace according to the invention is distinguished in that it contains, in addition to the gas burner, an electric heating device which possesses a thermal heating capacity corresponding substantially to the heating capacity of the gas burner, and which is constructed in such a way that the steel strip can be heated in the hood-type annealing furnace by the electric heating device alone, with the gas burner switched off, to a temperature above 500° C., preferably above the recrystallization annealing temperature of the steel material which usually lies in the region of about 730° C.

Although, in principle, the heating of the furnace can take place by using only a single gas burner, a plurality of such gas burners are preferably provided. However, the flames thereof are directed onto the outsides of a protective hood having an inner space in which the protective gas and the steel strip coils to be heated are accommodated.

The hood-type annealing furnace according to the invention possesses the advantage that it can be operated economically to the highest degree. Thus, in the first place, it is possible, in the case of high utilization of the public power network, to operate the furnace in a known way solely by the gas burner, thus resulting in comparatively favorable operating costs because of the high efficiency and, in comparison with electrical current, favorable energy costs for the gas which is used for this purpose and which is preferably natural gas.

If an energy surplus occurs because of overcapacities in the public power network, the operation of the gas burners can be interrupted within the shortest possible time, for example within one to two minutes, especially during a heating phase and the electric heating device can be activated, with the result that the peak load in the public network is advantageously reduced. If the hood-type annealing furnace according to the invention is dimensioned in the customary way, for example, the heating capacity of the gas burner or gas burners and preferably also of the electric heating device lies in each case, overall, in the region of, for example, 1800 kW, thus resulting in a considerable relieving of the load upon the public power network for the duration of a heating phase which may amount, for example, to 10 hours. Since, in times of an over-capacity of the electrical energy in the public power network, the electrical energy can be obtained considerably more favorably or even free of charge by large customers which at any time consume outputs in the region of approximately 2000 KW, the hood-type annealing furnace according to the invention can be operated more cost-effectively than with gas during the above-mentioned peak load phases. The underlying reason for this is that the network operators have a considerable interest in avoiding damage to the grid and to the connected consumers which is caused by overvoltages.

Furthermore, the combination according to the invention of an electric heating device and of a gas heating device affords the possibility, when they are operated simultaneously, of shortening the heating phases, as desired, as a result of which, in particular, the time duration of a single annealing operation can be reduced and therefore the economical efficiency of a plant having a multiplicity of hood-type annealing furnaces, for example 10 or 20 hood-type annealing furnaces, can be increased overall, even though, when the hood-type annealing furnace according to the invention is being heated up, higher costs are initially incurred because of the electrical energy used in addition to gas.

In accordance with another feature of the invention, a control device is preferably provided in order to interrupt the supply of gas to the burner when a surplus of electrical energy occurs in the public power network and in order to subsequently or even simultaneously activate the electric heating device. The control device or controller deactivates the burners and activates the electric heating device or heater preferably on the basis of external commands or data which are delivered to it, for example, from a central control station of the power network operator. Alternatively, there is the possibility that the control device monitors, if appropriate even automatically, the instantaneous voltage situation and/or frequency situation in the assigned part of the power network and, when fixed desired values which are a measure of the instantaneous load upon the power network are overshot, deactivates the gas burner automatically and activates the electric heating device.

In accordance with a further preferred feature of the invention, the electric heating device includes a multiplicity of individual electric heating devices of lower power, and the control device which controls the heating devices electrically connects these individually or else in smaller groups in succession to the public power network at the time of switchover to electrical heating operation. This affords the advantage that the electrical switching capacity for switching the heating device on and off is lower by a multiple than when all of the heating devices are switched over simultaneously, as a result of which markedly more cost-effective electrical switching elements can be used.

In accordance with an added preferred feature of the hood-type annealing furnace of the invention, the protective hood is surrounded by an annealing or heating hood on which the burners are accommodated. In this embodiment of the invention, between the protective hood and the annealing or heating hood, a combustion space or chamber is defined, in which the flame and the hot exhaust gas of the gas burner act with thermal energy upon the outside of the protective hood. By contrast, the electric heating device is advantageously located, outside of the stream of exhaust gas, below the gas burner and/or in a portion, set back radially with respect to the combustion space, of the heating hood, with the result that the electric heating device is not additionally heated, during the burner operation, by up flowing hot exhaust gas of the burner or burners. An additional cooling device for the heating device can consequently be dispensed with, and the service life of the latter is increased, overall, due to the lower working temperatures.

In accordance with an additional preferred feature of the invention, the electric heating device acts with thermal energy upon the outside of the protective hood which is manufactured, in particular, from metal, in particular from steel of high thermal load-bearing capacity, in order to heat indirectly, through the wall of the protective hood, the protective gas which circulates in the inner space or chamber of the protective hood. In this embodiment of the invention, the electric heating device includes a multiplicity of electrically operated NIR emitters which are accommodated on the wall of the preferably thermally insulated heating hood and act directly with infrared radiation upon the outside of the protective hood. NIR emitters of this type are known from the prior art and can be procured in abundant quantities at comparatively low costs. The known NIR emitters are used, for example, for the local heating of metal workpieces or other material and are distinguished by a high efficiency. The use of NIR emitters, which are sold, for example, by the company Heraeus-Nobelight GMBH in Kleinosthein, Germany, as modules and which, for example, possess a radiated power of 4 KW in the case of a length of 1 m and of a diameter of approximately 2 cm, affords the advantage that the inner wall of the heating hood can be covered in the lower part virtually completely with several hundred standing emitters. The emitters are configured, for example, as rod-shaped tubes and, preferably standing together with a rear-side reflector, are fastened next to one another to the inner wall of the heating hood, so that the overall infrared radiation is conducted by the reflectors in the direction of the outside of the protective hood. Using the above-mentioned emitters affords the advantage that existing protective hoods can, if desired, be retrofitted with a heating device independently of their diameter. In addition, the emitters, which are operated in each case with a voltage of, for example, 230 V or 400 V, can at low outlay be connected by suitable electric switching devices, such as, for example, contactors, in succession or else in groups within a few seconds to the power network to be relieved, without switching capacities arising which can be switched only at considerable outlay in technical terms and under special protective precautions.

In accordance with yet another alternative feature of the invention, the protective gas is circulated in a closed circuit by a further blower through a heat exchanger which is disposed outside the protective hood and which is acted upon with thermal energy from outside by the electric heating device in order to heat the protective gas circulated through the heat exchanger. This affords the advantage that the heat energy provided by the electric heating device which, for example, may also be an inductively acting heating device or else an Ohmic resistance heating device, is not transmitted through the wall of the protective hood, but instead directly to the protective gas, with the result that efficiency is additionally improved. In this embodiment, it is a further advantage that the protective hoods and also heating hoods employed heretofore can continue to be used, and the heating capacity of the electric heating device can be adapted at comparatively low outlay, by the choice of the size of the heat exchanger used, to the desired value which preferably corresponds substantially to the value of the maximum heating capacity of the burner or burners and lies, for example, in the range of 1200 kW to 1800 kW.

In accordance with yet a further feature of the invention, in the last-described embodiment, it is advantageous if the electric heating device is disposed inside the heat exchanger and is washed around by the circulating protective gas. As a result, the temperature which the heating device assumes while it is operating can be held at low outlay, through the protective gas temperature which is constantly controlled during the heating phase, below the maximum permissible temperature at which the heating device can be operated and which, of course, lies above the recrystallization annealing temperature of approximately 750° C.

In accordance with yet an added feature of the invention, in the last-described embodiment too, the electric heating device preferably includes a multiplicity of NIR emitters which are preferably disposed inside the heat exchanger and act directly with infrared radiation upon a sheet-like component, in particular a metal sheet, which is disposed in the inner space of the heat exchanger and around which the protective gas flows. This affords the advantage that the radiated power delivered to the protective gas can be adapted at low outlay to the desired power by increasing or reducing the size of the surface of the sheet-like component.

With the objects of the invention in view, there is concomitantly provided a method for operating the above-described hood-type annealing furnace, which comprises the following steps: when a surplus of electrical energy occurs in the public power network, the control device connects the electric heating device to the public power network until the recrystallization annealing temperature or a stipulated maximum temperature lying above it is reached, and subsequently, the control device breaks the electrical connection between the electric heating device and the public power network and makes at least one further electrical connection to an electric heating device of at least one substantially identically constructed further hood-type annealing furnace, until the surplus of electrical energy in the public power network is reduced.

Other features which are considered as characteristic for the invention are set forth in the appended claims.

Although the invention is illustrated and described herein as embodied in a hood-type annealing furnace and a method for operating the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
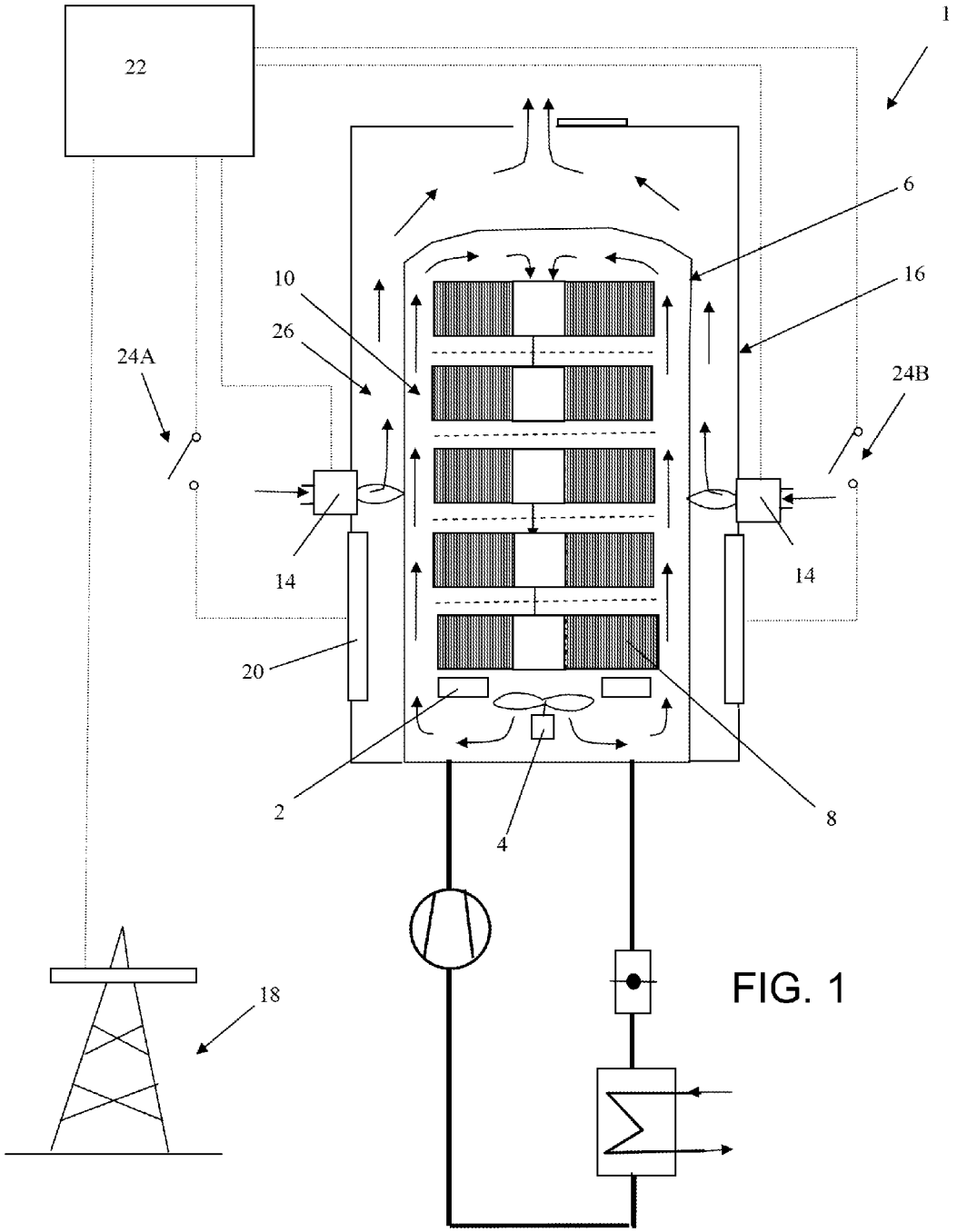
FIG. 1 is a diagrammatic, longitudinal-sectional view of a hood-type annealing furnace according to the invention during heating, in which thermal energy is delivered solely by gas burners.
Figure 2:
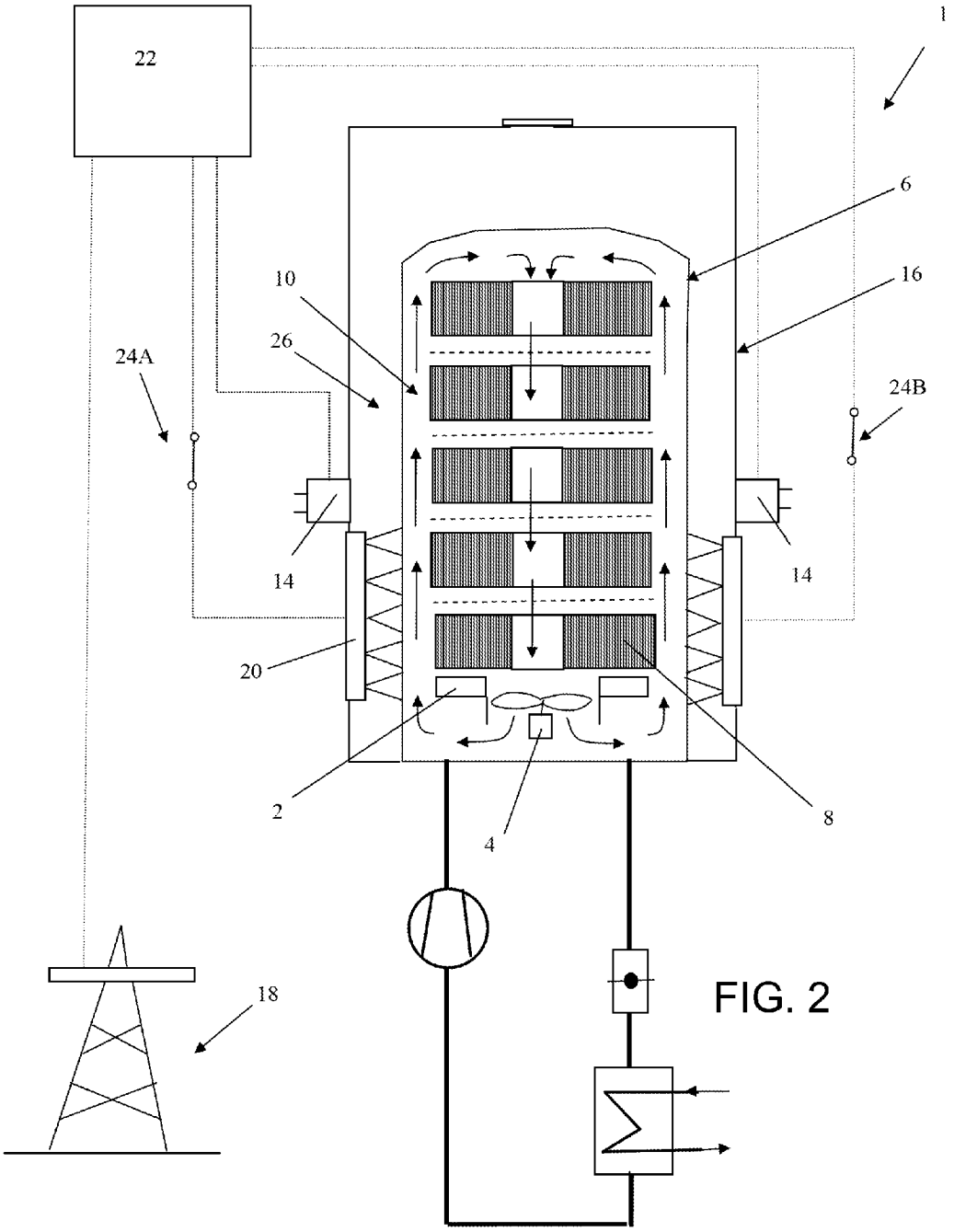
FIG. 2 is a longitudinal-sectional view of the hood-type annealing furnace of FIG. 1, in which, to relieve the public power network, the thermal heating energy is delivered during a heating phase solely by an electric heating device in the form of NIR emitters.

Referring now to the figures of the drawings in detail and first, particularly, to FIGS. 1 and 2 thereof, there is seen a hood-type annealing furnace 1 according to the invention which includes a base 2 in which a blower 4 is disposed and located on the underside of a protective hood 6 which can be placed onto the base 2. Coils 8 of cold-rolled steel strip are deposited one above the other on the base 2 in a known way, are heated in the hood-type annealing furnace 1 in a known hood annealing process to the recrystallization annealing temperature in the range of approximately 700 to 750 degrees Celsius and are held at this temperature for a stipulated time duration of, for example, 5 to 8 hours.

In order to protect the coils 8 from oxidation or other chemical changes during the hood annealing process, an inner space 10 of the protective hood 6, which is gas-tightly sealed-off with respect to the outside, is acted upon with a protective gas, in particular with hydrogen gas or with nitrogen gas, which is introduced into the inner space 10 through non-illustrated supply lines.

In order to heat the protective gas inside the inner space 10 to a temperature in the region of the recrystallization temperature during a so-called heating phase while this protective gas is circulated through between the coils 8 according to the arrows during conventional gas operation, the outside of the protective hood 6 is heated by the hot gas of a diagrammatically illustrated gas burner or a plurality of gas burners 14 which are accommodated on a heating hood 16 that is placed over the protective hood 6, after the protective hood 6 has been put into place. The exhaust gas of the gas burners 14 in this case rises on the outer wall of the protective hood 6 in a combustion space 26 defined between the inside of the heating hood 16 and the outer wall of the protective hood and is discharged from the heating hood 16, for example, through an orifice, illustrated by way of example on the top side of the heating hood. The exhaust gas may, if appropriate, be used in a heat exchanger for preheating combustion air delivered to the burners 14, although this is not shown any further in the drawings for illustrative reasons.

The hood-type annealing furnace 1 according to the invention furthermore includes an electric heating device or heater which, in the embodiment of the invention shown in FIGS. 1 and 2, is formed by NIR emitters 20. These emitters 20 are disposed in the lower region of the heating hood 16 and are connected by a control device or controller 22, preferably successively in groups, to the public power network 18 which is symbolized by a tower.

During straightforward burner operation (FIG. 1), which constitutes the main operating mode, the control device 22 interrupts the electrical line connection to the public power network 18, so that the electric heating device is deactivated. The interruption in the connection to the electric power network 18 is indicated in FIG. 1 by opened switches 24A and 24B.

If a surplus of electrical energy occurs for a short time in the public power network 18, for example because there is suddenly a surplus of electrical current from wind power and solar power on a windy and sunny Sunday afternoon, the control device 22 interrupts the supply of gas to the burners 14, so that they no longer act with thermal energy upon the outside of the protective hood 6. Subsequently, the switches 24A and 24B, which represent an appropriate number of switches and through which the NIR emitters 20 are connected to the public power network 18, are closed. As a result, the NIR emitters, which in each case have a power of, for example, 5 kW, are acted upon within a few seconds by electrical energy from the public power network 18, with the result that the surplus of electrical energy is counteracted and the power network is relieved. The NIR emitters 20 radiate their electromagnetic radiation, which has a radiation spectrum in the infrared spectral range preferably tuned to the heating of irradiated objects, preferably directly onto the outside of the protective hood 6, with the result that the latter is heated. The heat energy passing through the wall of the protective hood 6 is transmitted on the inner wall of the protective hood, in the inner space 10, to the protective gas which flows in an upward direction along the inner wall and which is thereby likewise heated.

The protective gas, heated indirectly by the emitters 20 in the manner described above and circulated continuously in the inner space 10 by the blower 4, subsequently discharges the absorbed heat energy to the coils 8 when the protective gas flows around the coils 8, as is indicated by the arrows in FIGS. 1 to 3.

When there is no longer the surplus of electrical energy in the public power network 18, the control device 22 interrupts the supply of current to the electric heating device, that is to say to the emitters 20, and once again activates the supply of gas to the burners 14 and ignites them, so that the protective gas in the inner space 10 of the protective hood 6 is once again heated by the open flames of the gas burners 14 which act upon the outside of the protective hood 6. As may be gathered in detail in this case from the illustration in FIGS. 1 and 2, the electric heating device in the form of the NIR emitters 20 is disposed below the burners 14, so that the hot exhaust gas generated by the burners 14 can rise in the combustion space 26, without heating the emitters 20. As a result, the service life of the emitters 20 is increased considerably, and contamination of the emitters by soot constituents contained in the exhaust gas is likewise prevented.

Figure 3:
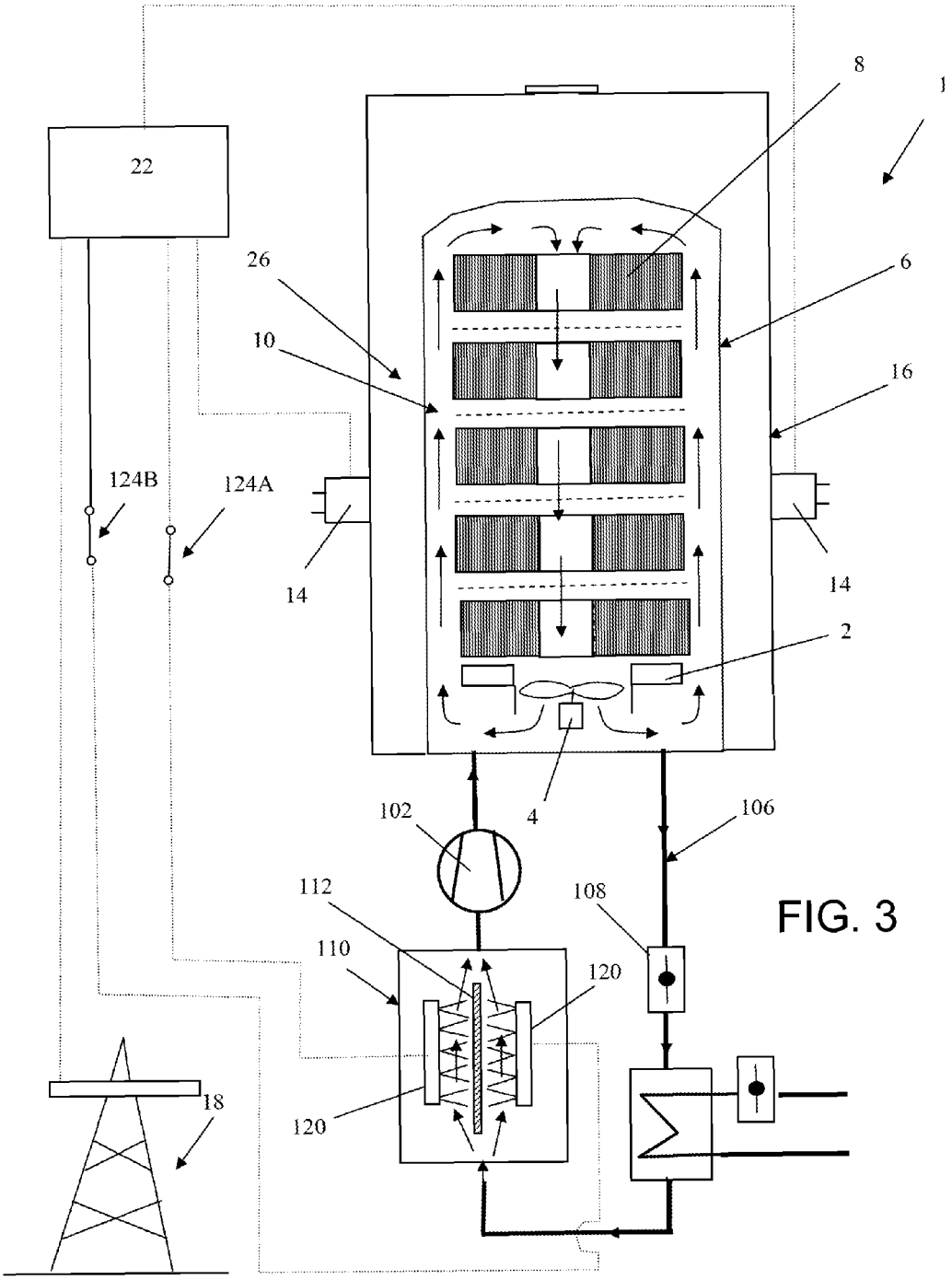
FIG. 3 is a longitudinal-sectional view of a further embodiment of the hood-type annealing furnace according to the invention, in which, to relieve the public power network, the thermal energy is delivered by a heating device with NIR emitters which heat a sheet-like component inside a heat exchanger through which protective gas flows.

According to a further embodiment of the invention which is shown in FIG. 3, when the hood-type annealing furnace 1 of the type described above is equipped with gas burners 14 the heating of the protective gas takes place, as an alternative to the NIR emitters 20 disposed in the combustion space 26, in such a way that the protective gas is circulated through a further blower 102 in a closed circuit 106 which preferably includes a valve 108 and a heat exchanger 110 through which the protective gas can be conducted during the heating phase. In this embodiment of the invention, the heat exchanger 110 contains the heating device or heater in the form of further NIR emitters 120 which, in a similar way to the emitters 20, are connected in groups to the control device 22 which switches them on in groups through the symbolically indicated switches 124A and 124B when a surplus of electrical energy occurs in the public power network 18. As can also be gathered in this case from the illustration in FIG. 3, the NIR emitters 120 emit their heat radiation preferably to a sheet-like component 112, in particular a dark metal sheet, which is disposed in the inner space of the heat exchanger 110 and which is cooled by the protective gas flowing around it, in order to heat the protective gas to a temperature of approximately 800° C. or more before it is fed into the inner space 10.

As may also be gathered from the illustrations of FIGS. 1 to 3, at least one further non-illustrated heat exchanger may be capable of being incorporated into the protective gas circuit 106. Through the use of that heat exchanger, heat energy is extracted from the protective gas after the end of the annealing phase, in order to cool the coils 8 again according to a stipulated temperature profile and to at least partially again recover the heat energy which is extracted from the protective gas or the coils 8 in this case through non-illustrated devices.

The invention claimed is:

1. A hood-shaped annealing furnace for the thermal treatment of cold-rolled steel strip, the hood-shaped annealing furnace comprising:

a base;

a protective hood configured to be placed on said base and to receive the steel strip under said protective hood;

a gas burner having a heating capacity and being configured to heat a protective gas atmosphere;

a blower configured to circulate the protective gas atmosphere heated by said gas burner under said protective hood and to heat the steel strip under said protective hood to a temperature of at least 500° C. in the protective gas atmosphere;

an electric heater fed by a public power network and having a heating capacity corresponding substantially to said heating capacity of said gas burner, said electric heater configured to independently heat the protective gas atmosphere as an alternative to said gas burner to a temperature above a recrystallization annealing temperature with said gas burner switched off; and a controller configured to interrupt a supply of gas to said gas burner and activate said electric heater in the event of a surplus of electrical energy in the public power network.

2. The hood-shaped annealing furnace according to claim 1, wherein said electric heater includes a multiplicity of individual low-power electric heaters, and said controller is configured to electrically connect said low-power electric heaters to the public power network in succession individually or in groups, upon said hood-shaped annealing furnace being switched over to electrical heating operation.

3. A hood-shaped annealing furnace for the thermal treatment of cold-rolled steel strip, the hood-shaped annealing furnace comprising:

a base;

a protective hood configured to be placed on said base and to receive the steel strip under said protective hood;

a heating hood surrounding said protective hood and defining a combustion space between said protective hood and said heating hood;

said combustion space configured to contain a flame and hot exhaust gas of said gas burner acting with thermal energy upon an outside of said protective hood;

a gas burner having a heating capacity and being configured to heat said protective gas atmosphere;

a blower configured to circulate the protective gas atmosphere heated by said gas burner under said protective hood and to heat the steel strip under said protective hood to a temperature of at least 500° C. in the protective gas atmosphere; and an electric heater fed by a public power network and having a heating capacity corresponding substantially to said heating capacity of said gas burner, said electric heater configured to independently heat the protective gas atmosphere as an alternative to said gas burner to a temperature above a recrystallization annealing temperature with said gas burner switched off;

said electric heater being accommodated at least one of outside a stream of the exhaust gas below said gas burner or in a portion of said heating hood set back radially with respect to said combustion space;

said electric heater including a multiplicity of NIR emitters configured to act directly with infrared radiation upon an outside of said protective hood.

4. The hood-shaped annealing furnace according to claim 2, wherein said protective hood has an inner space, and said electric heater is configured to act with thermal energy upon an outside said protective hood to indirectly heat the protective gas atmosphere circulating in said inner space, through a wall of said protective hood.

5. The hood-shaped annealing furnace according to claim 2, wherein said low-power electric heaters include a multiplicity of NIR emitters configured to act directly with infrared radiation upon an outside of said protective hood.

6. A hood-shaped annealing furnace for the thermal treatment of cold-rolled steel strip, the hood-shaped annealing furnace comprising:

a base;

a protective hood configured to be placed on said base and to receive the steel strip under said protective hood;

a gas burner having a heating capacity and being configured to heat a protective gas atmosphere;

a blower configured to circulate the protective gas atmosphere heated by said gas burner under said protective hood and to heat the steel strip under said protective hood to a temperature of at least 500° C. in the protective gas atmosphere;

an electric heater fed by a public power network and having a heating capacity corresponding substantially to said heating capacity of said gas burner, said electric heater configured to independently heat the protective gas atmosphere as an alternative to said gas burner to a temperature above a recrystallization annealing temperature with said gas burner switched off; and a closed circuit including a heat exchanger disposed outside said protective hood and a further blower configured to circulate the protective gas atmosphere through said heat exchanger;

said electric heater configured to act with thermal energy upon said heat exchanger from outside to heat the protective gas atmosphere circulated through said heat exchanger.

7. The hood-shaped annealing furnace according to claim 6, wherein said electric heater includes a multiplicity of NIR emitters disposed inside said heat exchanger and being washed around by the circulating protective gas atmosphere.

8. The hood-shaped annealing furnace according to claim 7, wherein said heat exchanger has an inner space and a sheet-shaped component disposed in said inner space and configured to have the protective gas atmosphere flow around said sheet-shaped component, and said multiplicity of NIR emitters inside said heat exchanger are configured to act directly with infrared radiation upon said sheet-shaped component.

9. The hood-shaped annealing furnace according to claim 8, wherein said sheet-shaped component is a metal sheet.

10. The hood-shaped annealing furnace according to claim 1, wherein said controller is configured to operate said electric heater and said gas burner simultaneously to shorten a heating phase of the hood-shaped annealing furnace.

11. A method for operating a hood-shaped annealing furnace for the thermal treatment of cold-rolled steel strip, the method comprising the following steps:

providing a hood-shaped annealing furnace including:

a base, a protective hood configured to be placed on the base and to receive the steel strip under the protective hood, a gas burner having a heating capacity and being configured to heat a protective gas atmosphere, a blower configured to circulate the protective gas atmosphere heated by the gas burner under the protective hood and to heat the steel strip under the protective hood to a temperature of at least 500° C. in the protective gas atmosphere, and an electric heater fed by a public power network and having a heating capacity corresponding substantially to the heating capacity of the gas burner, the electric heater configured to independently heat the protective gas atmosphere as an alternative to the gas burner to a temperature above a recrystallization annealing temperature with the gas burner switched off;

upon a surplus of electrical energy occurring in the public power network, connecting the electric heater to the public power network using a controller until the coils have assumed the recrystallization annealing temperature or a stipulated maximum temperature lying above the recrystallization annealing temperature; and subsequently breaking the electrical connection between the electric heater and the public power network using the control device and making at least one further electrical connection to an electric heater of at least one substantially identically constructed further hood-shaped annealing furnace, until reaching a reduction in the surplus of electrical energy in the public power network.

* * * * *